US007486202B2

(12) United States Patent
Konishi et al.

(10) Patent No.: US 7,486,202 B2
(45) Date of Patent: Feb. 3, 2009

(54) VEHICLE COMMUNICATION DEVICE

(75) Inventors: Yoshichika Konishi, Obu (JP); Eiji Niwa, Nagoya (JP); Yasumasa Yamamoto, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 168 days.

(21) Appl. No.: 11/353,996

(22) Filed: Feb. 15, 2006

(65) Prior Publication Data

US 2006/0192687 A1 Aug. 31, 2006

(30) Foreign Application Priority Data

Feb. 16, 2005 (JP) ..... 2005-038693

(51) Int. Cl.
*G08B 1/00* (2006.01)

(52) U.S. Cl. ..... 340/932; 340/901; 340/995.1; 455/11.1; 455/22; 701/117

(58) Field of Classification Search ..... 340/903, 340/901, 902, 995.1, 995.11, 995.12, 932.2; 455/11.1, 15, 22, 23, 24; 701/117, 118
See application file for complete search history.

(56) References Cited

U.S. PATENT DOCUMENTS

| | | | | |
|---|---|---|---|---|
| 5,589,827 | A * | 12/1996 | Scurati | 340/901 |
| 6,150,961 | A * | 11/2000 | Alewine et al. | 340/995.1 |
| 6,236,337 | B1 | 5/2001 | Beier et al. | |
| 6,249,232 | B1 * | 6/2001 | Tamura et al. | 340/902 |
| 6,765,495 | B1 * | 7/2004 | Dunning et al. | 340/903 |
| 7,046,168 | B2 * | 5/2006 | Tsuboi | 340/903 |
| 7,151,467 | B2 * | 12/2006 | Fujita et al. | 340/902 |
| 2002/0198660 | A1 * | 12/2002 | Lutter et al. | 701/301 |
| 2004/0116106 | A1 * | 6/2004 | Shishido et al. | 455/414.2 |

FOREIGN PATENT DOCUMENTS

| | | |
|---|---|---|
| DE | 198 18 259 A1 | 11/1998 |
| EP | 0 860 954 A1 | 8/1998 |
| JP | 2001-283381 | 10/2001 |
| JP | 2003-168198 | 6/2003 |
| JP | 3520337 | 2/2004 |
| JP | 2004-118757 | 4/2004 |

OTHER PUBLICATIONS

Extended European Search Report (in English) issued by the European Patent Office in corresponding European Patent Application No. 06 10 0900, Mar. 8, 2007, Munich, DE.

* cited by examiner

*Primary Examiner*—George A Bugg
*Assistant Examiner*—Edny Labbees
(74) *Attorney, Agent, or Firm*—Buchanan Ingersoll & Rooney PC

(57) ABSTRACT

A vehicle communication device mounted to each of vehicles for sending and receiving information among plural vehicles includes a traveling lane detecting device for detecting a vehicle traveling lane on a road surface and an appropriateness of relay determining device for determining an appropriateness of relay on the basis of the vehicle traveling lane detected by the traveling lane detecting device, wherein the vehicle communication device assigns a vehicle to be requested to relay the information on the basis of the result determined by the appropriateness of relay determining device and sends the information to the assigned vehicle.

13 Claims, 8 Drawing Sheets

VEHICLE COMMUNICATION DEVICE

CROSS REFERENCE TO RELATED APPLICATIONS

This application is based on and claims priority under 35 U.S.C. § 119 to Japanese Patent Application 2005-038693, filed on Feb. 16, 2005, the entire content of which is incorporated herein by reference.

FIELD OF THE INVENTION

The present invention generally relates to a vehicle communication device, which is mounted to each of the vehicles, for sending and receiving information among the vehicles.

BACKGROUND

Various types of communicating device for sending and receiving signals among plural vehicles in order to exchange information have been known so far, and, for example, an inter-vehicle communication system disclosed in JP2001-283381A is capable of communicating information among plural vehicles traveling on a road. The inter-vehicle communication system includes a drive aiding camera mounted on the user's vehicle itself in order to support driving and captures images around the user's vehicle. On the basis of the captured images, traveling related information including a traffic condition around the user's vehicle is detected, and the information is transmitted to the other vehicles by means of a wireless transmitter.

Further, as a technology for general mobile communications, a Multi-hop Wireless Network has been known so far. For example, by means of the Multi-hop Wireless Network, signals can be relayed among moving bodies so that the moving bodies, which cannot directly communicate each other, can indirectly communicate each other. Further, a routing protocol used for building routes of various kinds of Multi-hop Wireless Networks has been developed.

On the road surface, marking lines are painted depending on various purposes in order to recognizing a border line of the traveling lane. The marking line is a solid line, a dashed line or a block type, and its color is white or yellow. These marking lines may be mixed. The lane borderline and a travel guiding line generally indicate a functional marking line, and the white and the yellow line generally indicate a lane mark. The vehicle traveling lane of this invention includes the functional marking line and the lane mark.

Various types of devices for detecting the vehicle traveling lane on the road surface, which is identified with a pair of white lines, have been provided so far. For example, according to a vehicle lane decision apparatus disclosed in JP2003-168198A, the marking lines drawn on the surface of a road is detected from an image captured by a camera, and the marking lines to be a pair of white lines dividing a traveling lane is extracted from them. Then, the interval between the pair of marking lines extracted as the white lines is detected. Under a situation where the interval between the pair of marking lines extracted as the white lines is detected, when the plurality of marking lines adjacent to each other are detected on at least one side of the road from the picture taken from the camera, based on the interval between the pair of marking lines as the white lines detected at the point of time, a pair of marking lines having an interval closest to the interval are extracted as the white lines.

Further, a traveling lane detecting device disclosed in JP2004-118757A includes a low-cost camera for determining a traveling lane in order to assist parking. Such device has been mounted to some kinds of vehicles on the market. Furthermore, a traveling lane detecting means disclosed in JP3520337B2 detects a vehicle traveling lane without using a captured image.

According to the device disclosed in JP2001-283381A, when the user's vehicle detects a traffic condition or abnormal occurrences, it sends the information to all vehicles, which exist within a range where a wireless communication is available. However, because the wireless communication generally uses signals of a high frequency wave, when obstacles such as a building exist between the vehicles, it becomes difficult to communicate between vehicles behind the obstacles.

Further, even when the signals are blocked by a building or the like and cannot be sent and received between two vehicles, using the routing protocol used for building routes of various kinds of Multi-hop Wireless Networks, the signals are relayed by another vehicle and appropriately sent and received between the two vehicles. However, within the Multi-hop Wireless Network between moving bodies such as vehicles, because the signals are randomly hopped, it takes some time to converge the route and communication efficiency is decreased The traveling lane detecting means disclosed in JP2001-283381A uses a camera, however, such camera is generally expensive and that may enhance the cost of the vehicle communication device as a whole.

A need thus exists to provide a low-cost vehicle communication device that can, even when an obstacle exists between vehicles, a signal is relayed by a vehicle, which is positioned at obstacle-free area and selected to relay the signal, in order to sent and receive the signal appropriately between vehicles.

SUMMARY OF THE INVENTION

According to an aspect of the present invention, a vehicle communication device mounted to each of vehicles for sending and receiving information among plural vehicles includes a traveling lane detecting means for detecting a vehicle traveling lane on a road surface; and an appropriateness of relay determining means for determining an appropriateness of relay on the basis of the vehicle traveling lane detected by the traveling lane detecting means, wherein the vehicle communication device assigns a vehicle to be requested to relay the information on the basis of the result determined by the appropriateness of relay determining means and sends the information to the assigned vehicle.

According to another aspect of the present invention, a vehicle communication device mounted to each of vehicles for sending and receiving information among plural vehicles includes a traveling lane detecting means for detecting a vehicle traveling lane on a road surface, an appropriateness of relay determining means for determining an appropriateness of relay on the basis of the vehicle traveling lane detected by the traveling lane detecting means, a first sending process means for sending a first signal including information indicating a vehicle condition and the result determined by the appropriateness of relay determining means, a first receiving process means for receiving the first signal sent by the first sending process means and memorizing the first signal in a memorizing means, a second sending process means for determining whether or not the relay is required on the basis of the first signal memorized in the memorizing means, and sending a second signal including information of a vehicle assigned to be requested to relay the signal; and a second receiving process means for receiving the second signal sent by the second sending process means in order to determine whether or not the relay request exists, and relaying the signal to the vehicle assigned to be requested to relay the signal.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
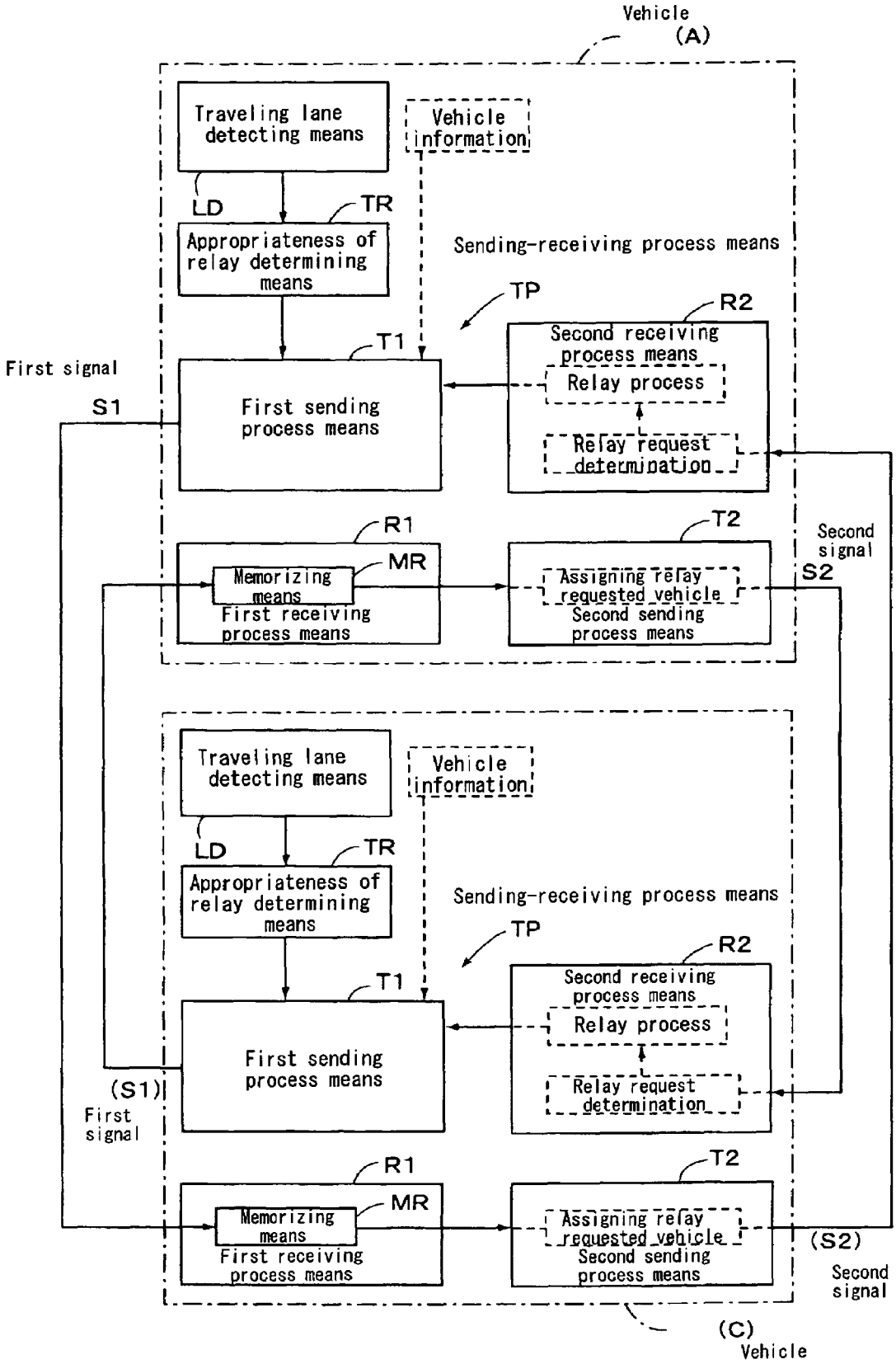
FIG. 1 illustrates a configuration of an embodiment of the vehicle communication device according to the present invention.

An embodiment of the vehicle communication device according to the present invention will be explained in accordance with the attached drawings. As shown in FIG. 1, the vehicle communication device is mounted to each of the vehicles, such as a vehicle A and a vehicle C, and they communicate each other as described later. Specifically, each of the vehicles A and C illustrates with dashed lines in FIG. 1 includes a traveling lane detecting means LD, an appropriateness of relay determining means TR and a sending-receiving process means TP. More specifically, the traveling lane detecting means LD detects a vehicle traveling lane on the road surface, and the appropriateness of relay determining means TR determines whether or not the relay is appropriate on the basis of the detected result by the traveling lane detecting means LD. The sending-receiving process means TP sends a signal to a vehicle, which is selected as an appropriate vehicle to be requested for relaying the signal, on the basis of the result determined by the appropriateness of relay determining means TR.

Further, the sending-receiving process means TP is comprised of a first sending process means T1 for sending a first signal (S1), which includes information indicating a condition of the vehicle A and information indicating the result determined by the appropriateness of relay determining means TR. The vehicle A further includes a first receiving process means R1, a second sending process means T2 and a second receiving process means R2. Specifically, the first receiving process means R1 receives the first signal (S1) sent from the first sending process means T1 and sequentially memorizes the first signal (S1) in the memorizing means MR. The second sending process means T2 determines the propriety of relaying on the basis of the information memorized in the memorizing means MR and sends a second signal (S2) including information where a vehicle such as the vehicle C is assigned to be requested for relaying the signal. The second receiving process means R2 receives the second signal (S2) sent by the second sending process means T2 and determines whether or not the signal includes information related to the relay request. Further, when the second receiving process means R2 determines that the signal includes the relay request, the signal is relayed to another vehicle (except the user's own vehicle) such as the vehicle C. Thus, as shown in FIG. 1, the signal is sent and received between the vehicle A and the vehicle C, which has a same configuration as the vehicle A. The first signal (S1) and the second signal (S2) may not be set individually. Their functions are included in a sending and receiving signal, which is sent and received at a predetermined cycle as described later.

The traveling lane detecting means LD includes a traveling lane detecting sensor, which uses a low-cost optical sensor or a low-cost magnetometric sensor and provided at the front portion of the vehicle. Alternatively, a low-cost camera used for parking assist system disposed at the rear portion of the vehicle may be used. Further, each of the second sending process means T1, the second sending process means T2, the first receiving process means R1 and the second receiving process means R2 may be comprised of a wireless transceiver as mentioned below, and a configuration of each means is illustrated in FIG. 2.

Figure 2:
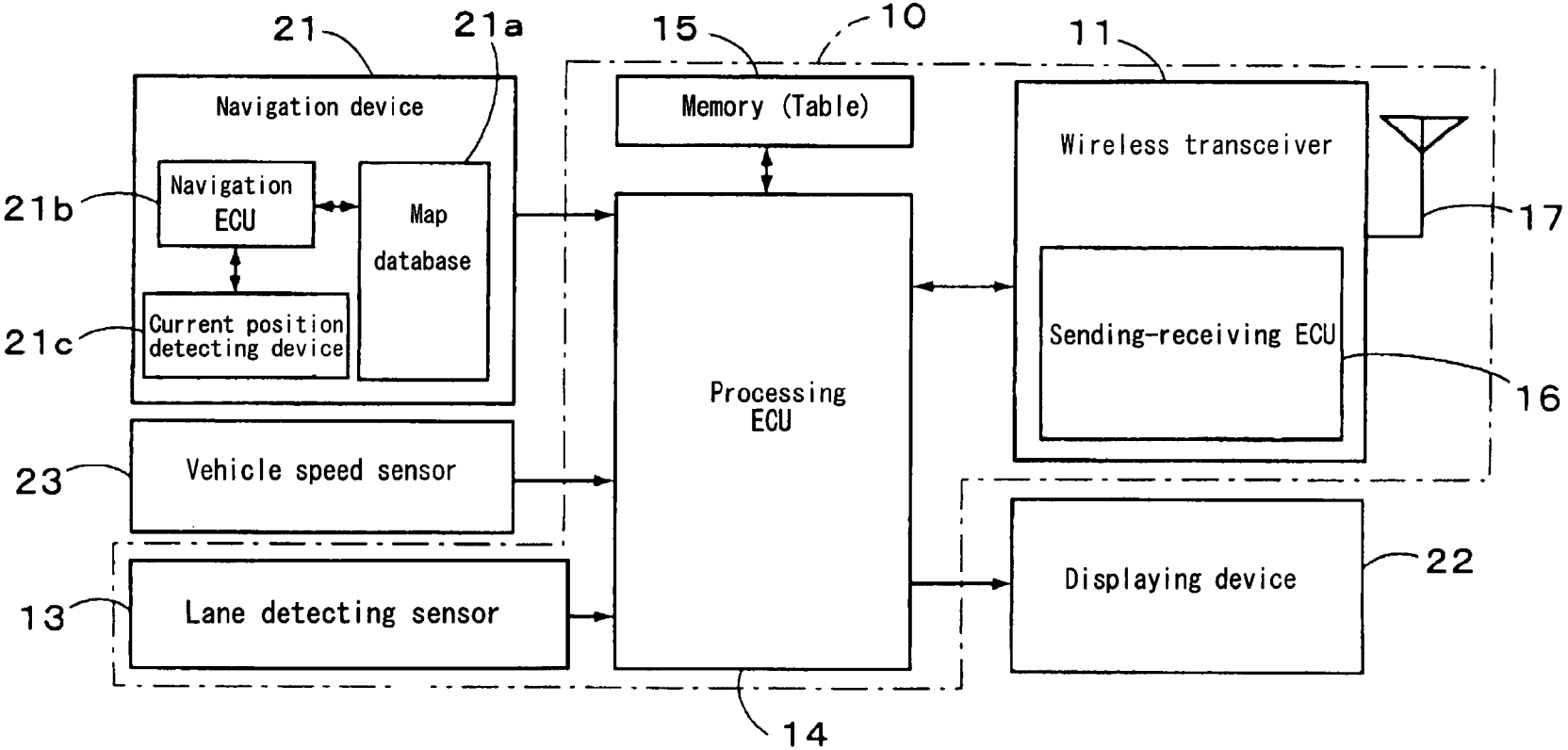
FIG. 2 illustrates a block diagram indicating an example of the configuration including the vehicle communication device according to the embodiment of the present invention.

FIG. 2 illustrates an example of the configuration of the vehicle communication device including the second sending process means T1, the second sending process means T2, the first receiving process means R1 and the second receiving process means R2. Specifically, a vehicle communication device 10 of this embodiment includes a wireless transceiver 11, a sending and receiving device (sending-receiving ECU (electric control unit)) 16 (e.g., serving as the sending process means and the receiving process means), a traveling lane detecting sensor 13 (e.g., serving as the traveling lane detecting means), a processing device (processing ECU) 14 (e.g., serving as the sending process means and the receiving process means) and a memory 15 (e.g., serving as the memorizing means). Further, a navigation device 21 and a displaying device 22 are connected to the processing ECU 14 of the vehicle communication device 10.

The wireless transceiver 11 is used for exchanging information by means of a wireless communication (sending and receiving) through an antenna 17 within a range in which the signal reaches at a predetermined output value of wireless communications. The information received by the wireless transceiver 11 is processed by the sending-receiving ECU 16 and outputted to the processing ECU 14 as necessary. Further, various kinds of information is directly sent to each of the vehicles, which exists within the range in which the signal can reach by the wireless means.

The information, which is sent by the wireless transceiver 11, includes information indicating the vehicle condition, for example the position of the user's vehicle, and indicating the traveling state. More specifically, the information indicating the position of the user's vehicle includes a current location of the user's vehicle detected by the navigation device 21. The information is represented by using latitude and longitude (hereinbelow referred to as a user's vehicle location). Further, the information further includes the lane information detected by the traveling lane detecting sensor 13. The information of the user's vehicle location, the traveling direction and the vehicle speed are provided to the sending-receiving ECU 16 by means of the processing ECU 14, and they are organized as vehicle information, to which a vehicle ID and data serial number are assigned. The vehicle information is sent at every predetermined time period. Further, a data forwarding number is automatically assigned. For example, "n" such as an integral number is assigned to the data, which is initially sent as the user's vehicle information, and "n−1" is assigned to the data forwarding from the vehicle, which receives the user's vehicle information. Specifically, every time the data is forwarded, the data forwarding number, in which one is subtracted from "n", is sequentially assigned. Further, in the sending-receiving ECU 16, when the data forwarding number of the received information is larger than zero, the information is relayed and forwarded (hopping).

The detected signal detected by the traveling lane detecting sensor 13 is outputted to the processing ECU 14. On the basis of the signal inputted from the traveling lane detecting sensor 13, the processing ECU 14 determines whether or not the road is crossed, forked or merged. When it is detected that the road is crossed, forked or merged, it is assumed that there is no obstacle such as a building or a wall, which blocks the radio signals. Thus, using a simple means such as the traveling lane detecting sensor 13, an existence of an obstacle of the communication can be determined indirectly.

The processing ECU 14 includes a digital computer, which is comprised of a RAM (random access memory), a ROM (read only memory), a CPU (central processing unit) or the like. On the basis of the output (traveling lane circumstance) from the processing ECU 14, it is determined whether or not a relay (hopping) is appropriate as mentioned later. Further, the processing ECU 14 displays a circumstance in a traveling direction of the user's vehicle is displayed on the displaying device 22 on the basis of the vehicle information of another vehicle inputted from the sending-receiving ECU 16 and includes various kinds of processes functions. Thus, these processes are shared by the processing ECU 14 and the sending-receiving ECU 16, however, they can be set flexible depending on the designing advantage.

The navigation device 21 includes a map database 21*a*, a navigation ECU 21*b*, and a current position detecting device 21*c*. The current position detecting device 21*c* detects a current position of the user's vehicle on the basis of the electric waves from plural GPS satellites. Then, the navigation ECU 21*b* obtains the information of the current position calculated by the current position detecting device 21*c*. On the basis of the information of the current position, a traveling direction of the user's vehicle is detected. Further, the vehicle speed sensor 23, for example, detects a pulse of the transmission and provides the processing ECU 14 as a vehicle speed signal.

The displaying device 22 is provided near the installment panel of the vehicle, and generally displays the information from the navigation device 21. The processing ECU 14 switches the displaying device 22 to display the image from the navigation device 21 or to display another image, for example an image of the environment in the traveling direction of the user's vehicle on the basis of the vehicle information sent from another vehicle.

Figure 3:
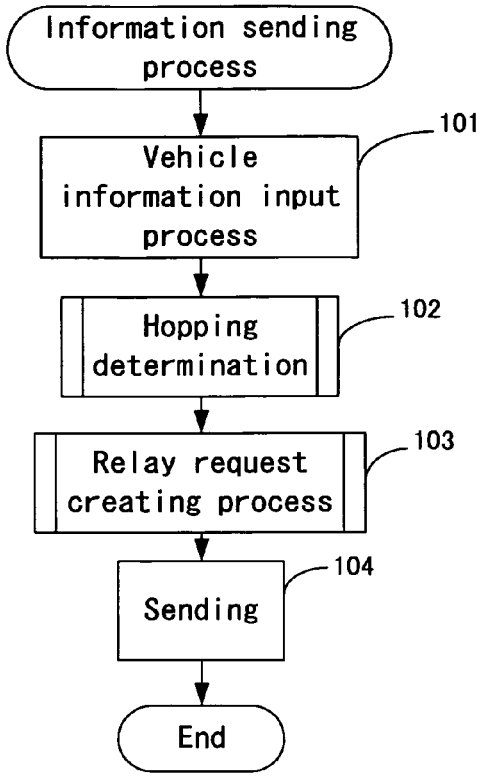
FIG. 3 illustrates a flow chart indicating a main routine of an information sending process according to the embodiment of the present invention.
Figure 4:
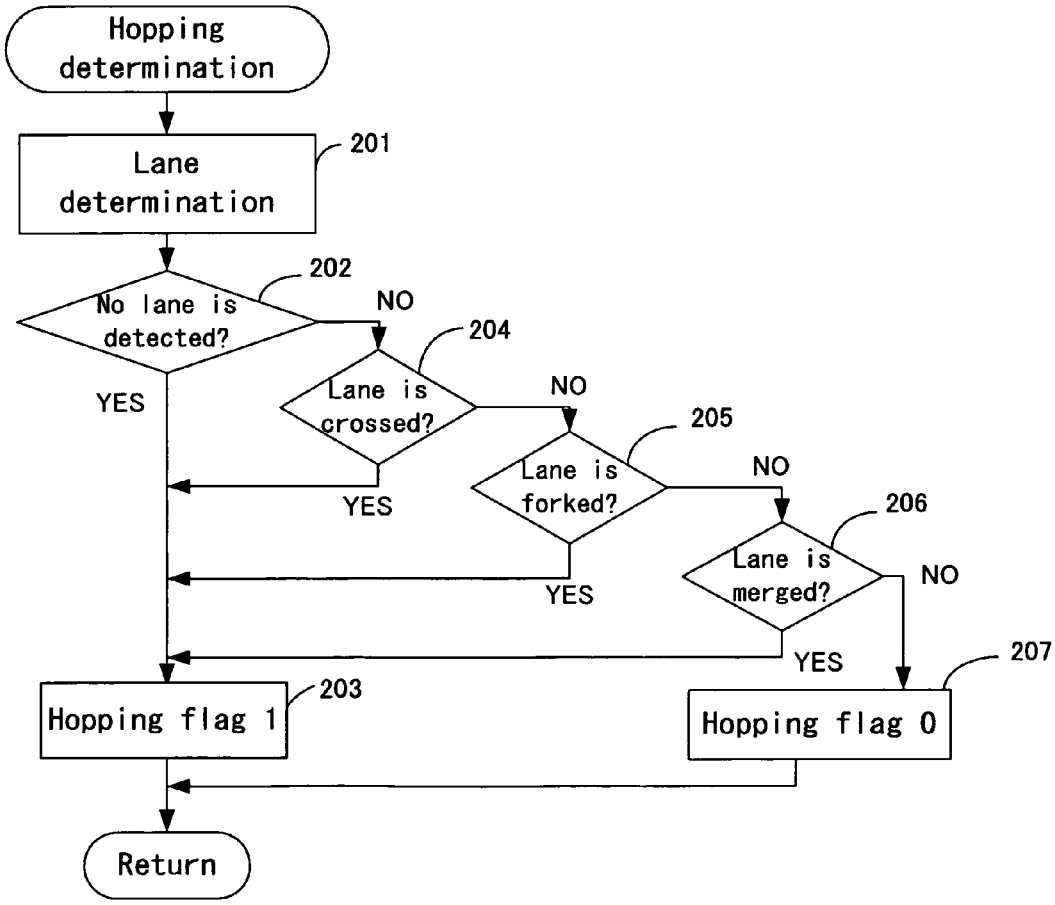
FIG. 4 illustrates a flow chart indicating a hopping determining process illustrated in FIG. 3 according to the embodiment of the present invention.
Figure 5:
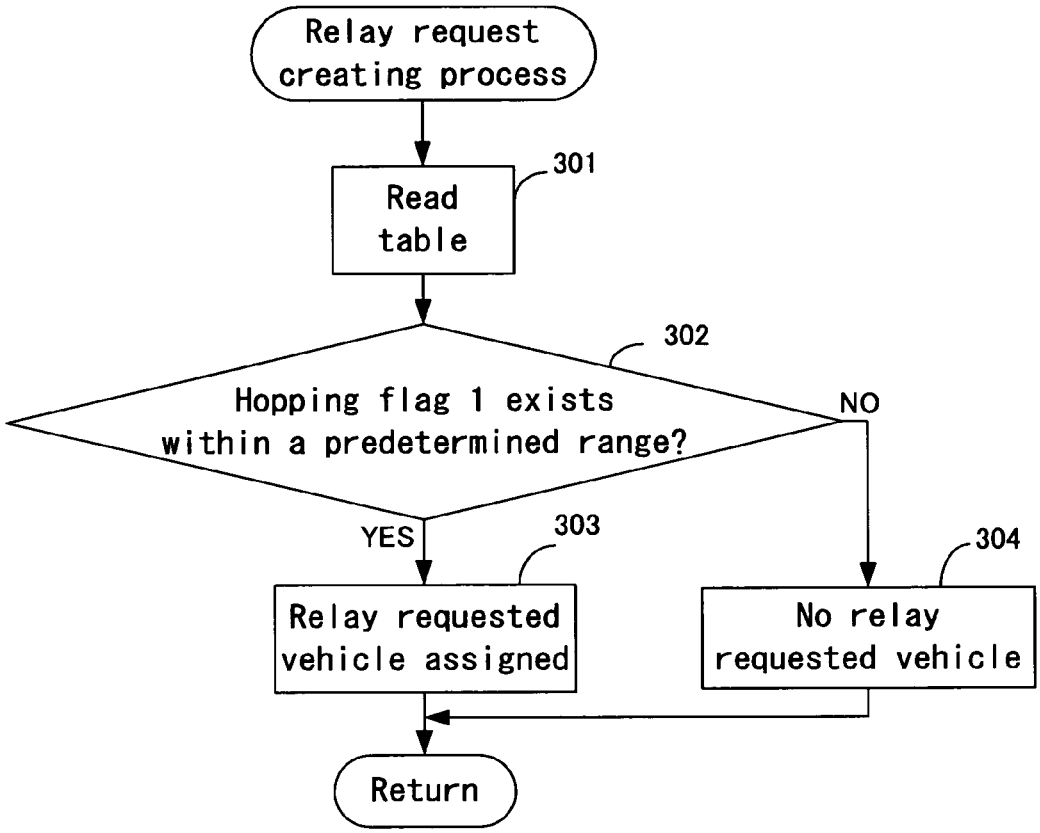
FIG. 5 illustrates a flow chart indicating a relay request creating process illustrated in FIG. 3 according to the embodiment of the present invention.
Figure 6:
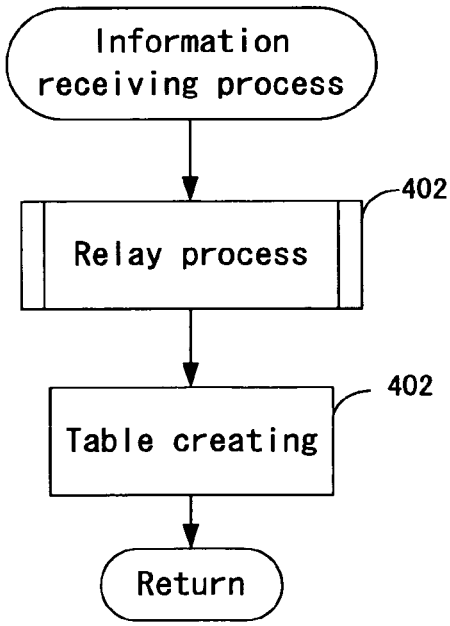
FIG. 6 illustrates a flow chart indicating a main routine of an information receiving process according to the embodiment of the present invention.
Figure 7:
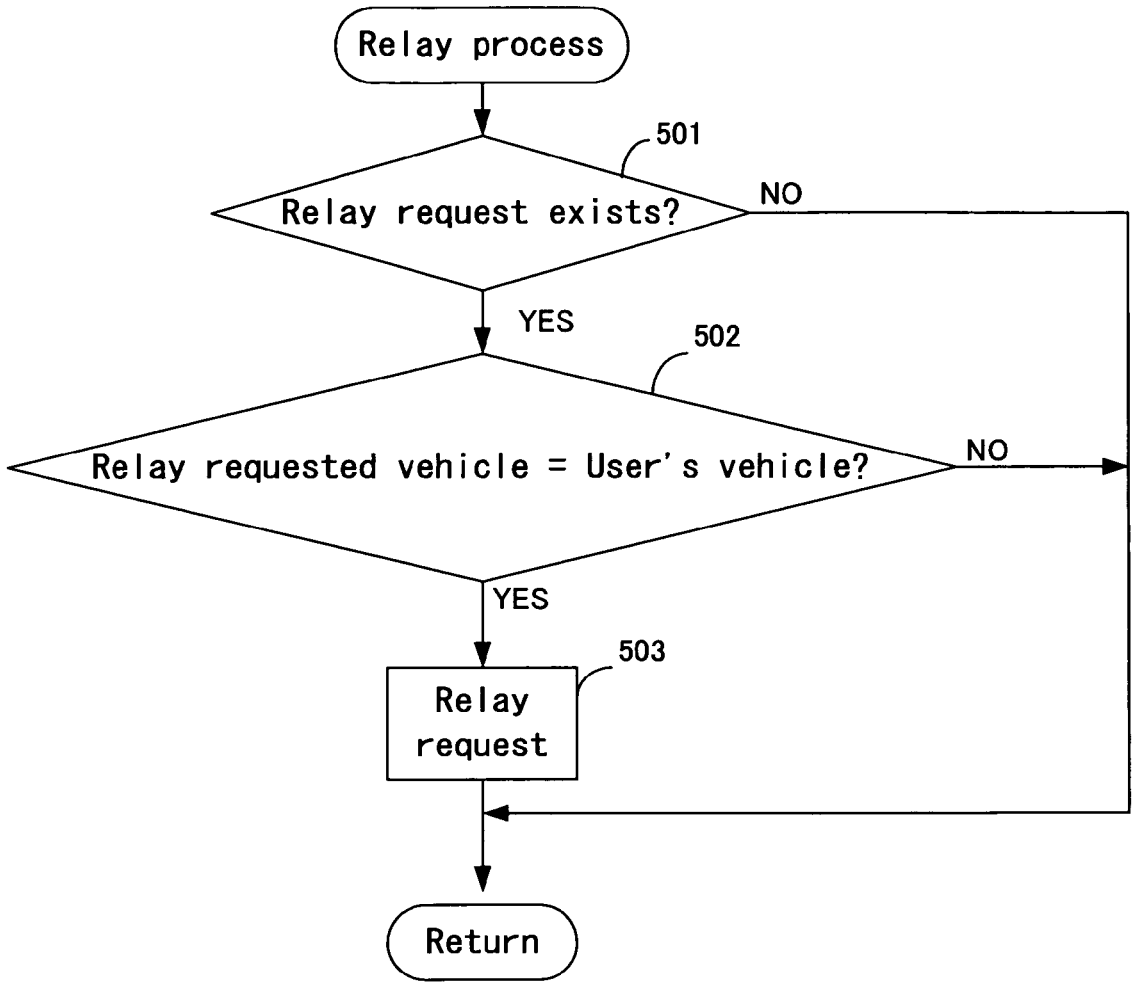
FIG. 7 illustrates a flow chart indicating a relay process according to the embodiment of the present invention.

The vehicle communication device 10 is mounted to each of the vehicles, and in each processing ECU 14 and each sending-receiving ECU 16 of each of the vehicle communication devices 10, sending and receiving processes of the information are repeated in predetermined cycles as shown in FIG. 3 through FIG. 7. FIG. 3 illustrates a main routine of the information sending process, and FIG. 4 and FIG. 5 is sub routines of the information sending process. The first sending process means T1 and the second sending process means T2 illustrated in FIG. 1 executes these routines. FIG. 6 illustrates a main routine of the information receiving process, and FIG. 7 illustrates the sub routine of the relay process. The first receiving process means R1 and the second receiving process means R2 illustrates in FIG. 1 executes these routines. In the sending and receiving processes illustrated in FIG. 3 through FIG. 7, processes of the first sending process means T1, the second sending process means T2, the first receiving process means R1 and the second receiving process means R2 of each vehicle are described together. To avoid confusion, the process executed in the vehicle A is explained as the process in the user's vehicle, and the process executed in the vehicle C is explained as the process in the another vehicle in accordance with FIG. 8 through FIG. 10.

First, as shown in FIG. 3, information such as the user's vehicle location, the traveling direction and the vehicle speed is input in Step 101, and the process goes to Step 102. In Step 102, it is determined whether or not the hopping (relaying, transferring) is appropriate, and then the process goes to Step 103. In Step 103, a relay request creating process is executed and in Step 104, the result in Step 103 is sent. The hopping determination in Step 102 is executed in the first sending process means T1 and the process of the hopping determination is executed as a flow chart illustrated in FIG. 4. Specifically, in Step 201 of FIG. 4, it is determined whether or not the vehicle traveling lane exists on the basis of the output from the traveling lane detecting sensor 13. When it is determined that the vehicle traveling lane is not detected, it is determined that the vehicle exists in an opened-environment, and the process goes to Step 203. In Step 203, "1" is set to a hopping flag. Alternatively, the hopping flag may not be set at this point.

Figure 8:
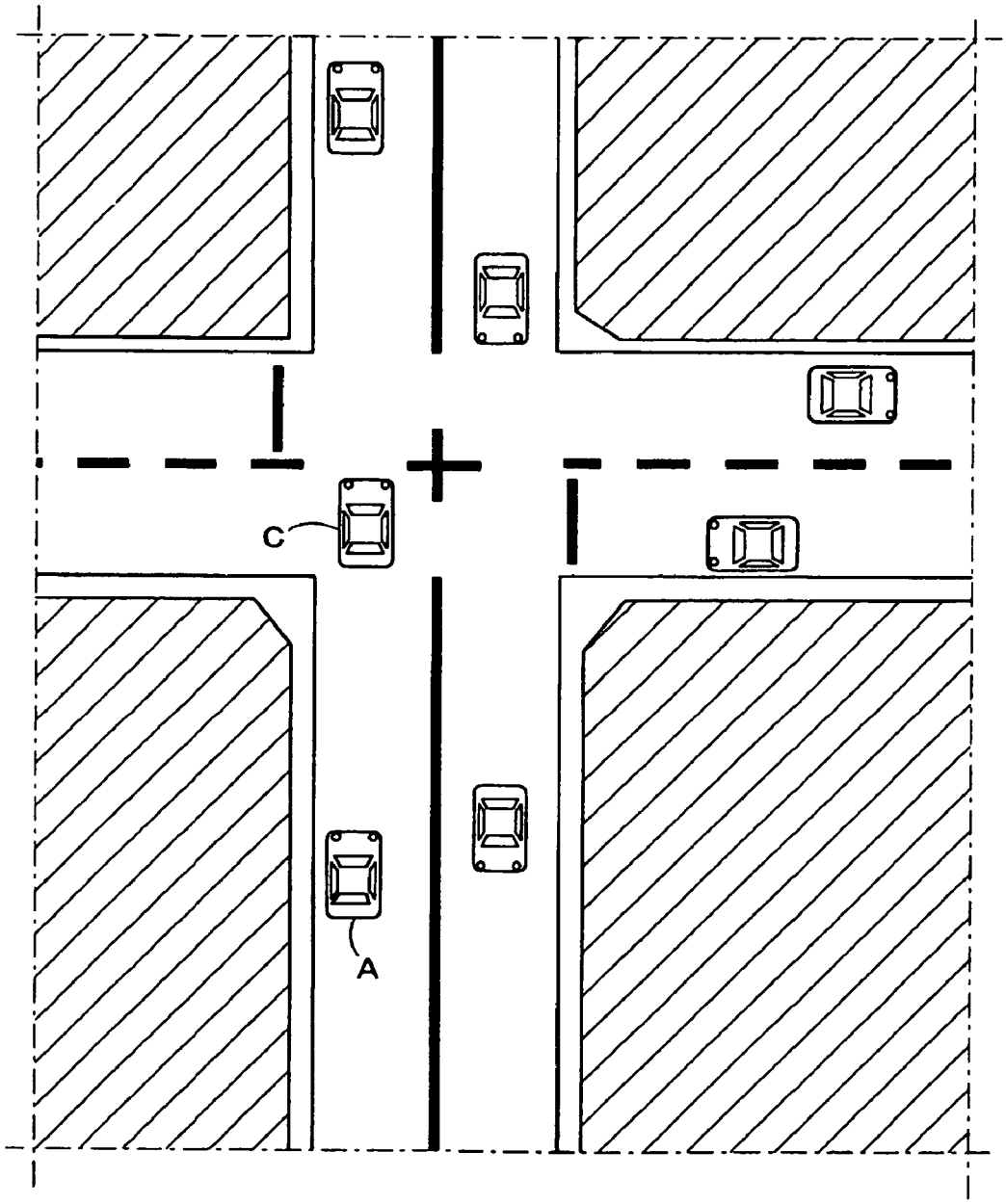
FIG. 8 illustrates a flat view indicating an example of a communication state of a vehicle located near an intersection (crossed) according to the embodiment of the present invention.

In Step 202, it is determined that the vehicle traveling lane is detected, condition of the lane is determined from Steps 204 through 206. On the basis of the determined result, the environment of the vehicle is assumed. Specifically, there is no obstacle around the vehicle such as a building illustrated with hatched lines, "1" is set to the hopping flag. For example, when the vehicle C enters an intersection as shown in FIG. 8, it is determined that the lanes around the vehicle is crossed, and then the process goes to Step 203 and "1" is set to the hopping flag. When the vehicle is not located at the intersection, the process goes to Step 205. In Step 205, it is determined whether or not the lane around the vehicle is forked as the vehicle C illustrated in FIG. 9. If it is determined that the lane is forked, the process goes to Step 203, and "1" is set to the hopping flag. In Step 205, if it is determined that the lane around the vehicle is not forked, the process goes to Step 206. In Step 206, it is determined whether or not the lane around the vehicle is merged as the vehicle C illustrated in FIG. 10. If it is detected that the lane is merged, the process goes to Step 203, and "1" is set to the hopping flag.

In Step 206, if it is determined that the lane is not merged, the process goes to Step 207 and "zero" is set to the hopping flag. Then, the process goes back to the main routine illustrated in FIG. 3. The hopping flag that is set through the process corresponds to the relay request result and sent in Step 104 to the surrounding vehicles as vehicle information together with the vehicle ID and a data serial number.

Then, the relay request creating process in Step 103 is executed by the second sending process means T2 as shown in FIG. 5. Specifically, in Step 301, the result of the hopping flag corresponding to the relay request result is read in a table for each vehicle provided at a memory 15 (memorizing means). For example, according to the vehicle A illustrated in FIG. 8 through FIG. 10, the hopping flag "0" is memorized in the table, and according to the vehicle C, the hopping flag "1" is memorized in the table.

Then, the process goes to Step 302. In Step 302, related to another vehicle positioned within a predetermined range (e.g., a range within which the signal reaches from the vehicle A at a predetermined output value of wireless communications), it is determined whether or not the vehicle has a hopping flag "1". As need arises, the hopping flag of vehicles which are positioned out of the predetermined range may be examined. For example, in step 303, the vehicle C, which exists at the front portion in the range within which the signal can reach from the vehicle A is assigned as a relay requested vehicle, which is requested to relay the signal, and the process goes to the main routine illustrates in FIG. 3. This information related to the relay requested vehicle, is includes in the vehicle information, which is sent in Step 104 in FIG. 3.

On the other hand, it is determined that there is no vehicle within the range in which the signal reached from the vehicle A, the process goes to Step 304. In Step 304, no vehicle is assigned as a vehicle, which can be required to relay the signal, and the process goes back to the main routine. The range that is used as a condition in Step 302 may be set on the basis of a predetermined distance from the user's own vehicle, however, when plural vehicles exist within the range, the vehicle existing farthest apart from may be assigned as the vehicle required to relay the signal. The condition may vary.

FIG. 6 illustrates a main routine of an information receiving process. Specifically, in Step 401, the second receiving process means R2 executes a relay process following a flow chart illustrated in FIG. 7. First, in Step 501, it is determined whether or not the relay request exists. Specifically, it is determined whether or not the relay request exists on the basis of the vehicle information. In Step 501, if it is determined that the relay is requested, the process goes to Step 502. In Step 502, on the basis of the vehicle information, which is sent from another vehicle, it is determined whether or not the relay requested vehicle is identical to the user's own vehicle. If it is determined that the relay requested vehicle is identical to the user's vehicle, the process goes to Step 503 and the signal is relayed by the user's vehicle. If it is determined that the relay requested vehicle is not identical to the user's vehicle, the information is not relayed by the user's vehicle.

Figure 9:
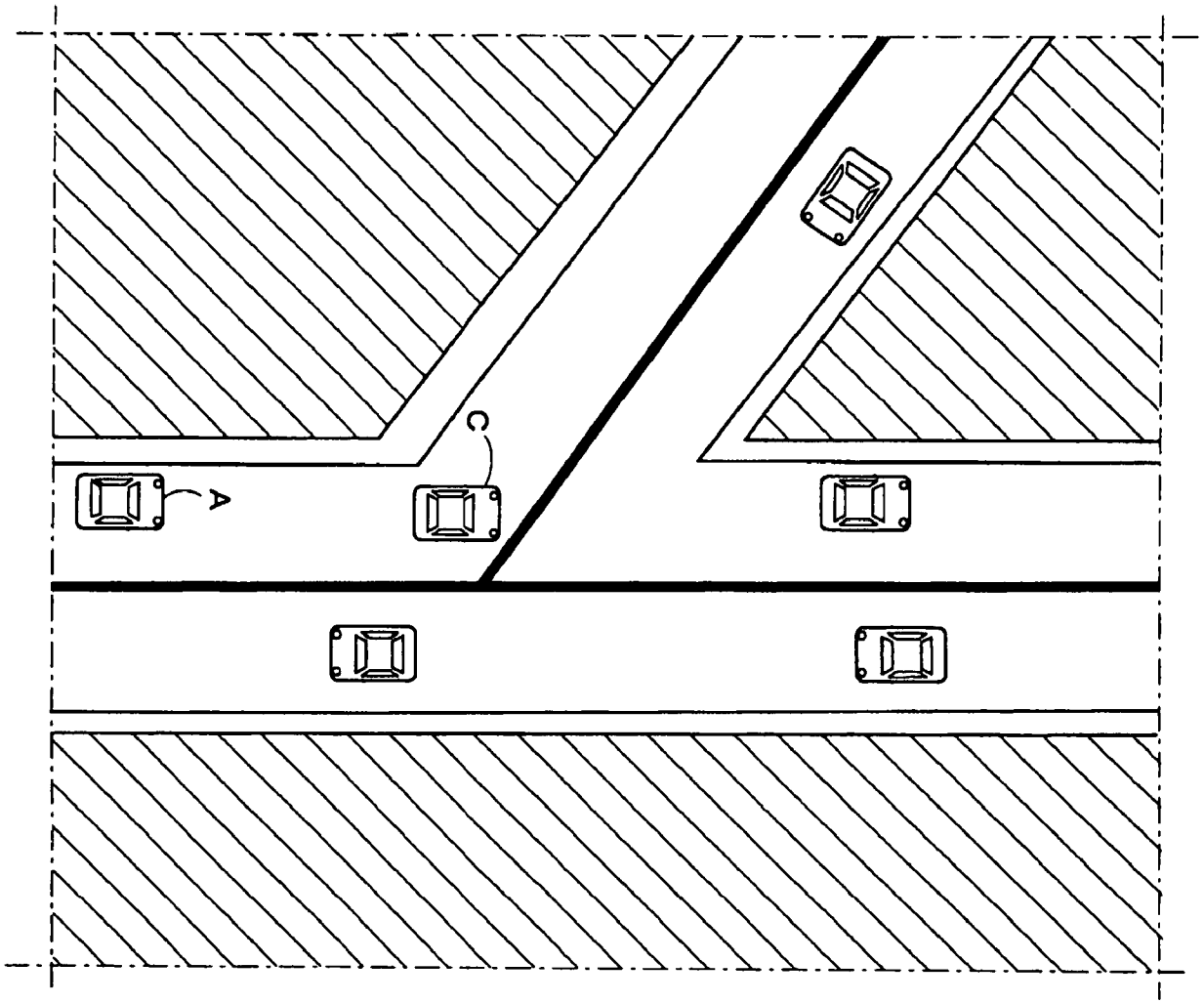
FIG. 9 illustrates a flat view indicating an example of a communication state of the vehicle located near an intersection (forked) according to the embodiment of the present invention.
Figure 10:
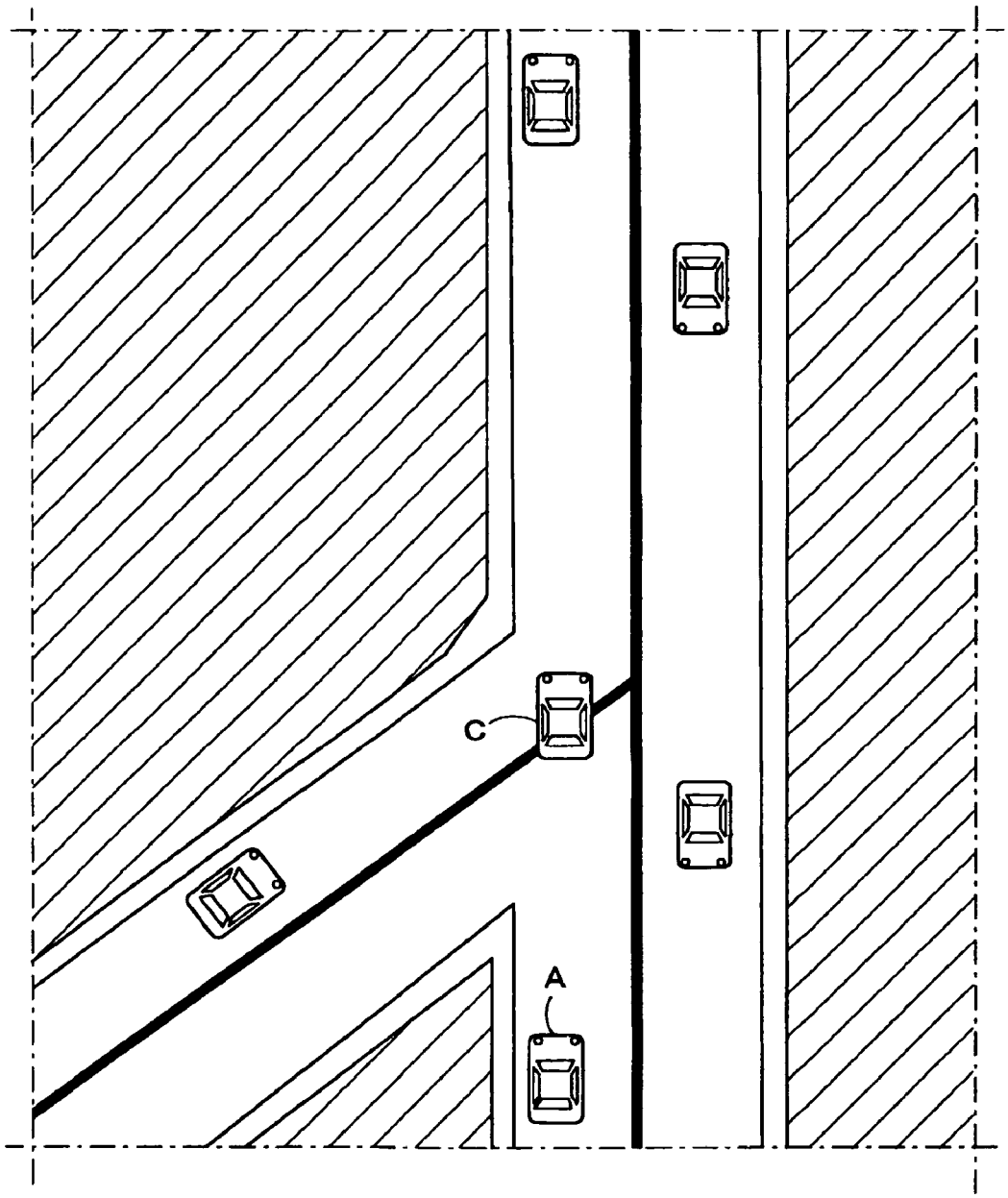
FIG. 10 illustrate a flat view indicating an example of a communication state of the vehicle located near an intersection (merged) according to the embodiment of the present invention.

For example, as shown in FIG. 8 through FIG. 10, when the vehicle A requests the vehicle C, which exists in a clear circumstance, to relay the signal, the vehicle information includes information about the vehicle C, which is requested to relay the signal. The vehicle C, which receives the information sent from the vehicle A, is considered as another vehicle relative to the vehicle A, however, when the information is relayed by the vehicle C, the vehicle C is considered as a user's own vehicle and executes the relay process. Specifically, in Step 503 illustrated in FIG. 7, the relay is requested by the second receiving process means R2 of the vehicle C relative to the first sending process means T1. Then, in the Step 503, depending on the above relay request, the detected result by the traveling lane detecting means LD is sent from the first sending process means T1 and received, for example, by the second receiving process means R1 of the vehicle A.

In this configuration, the vehicle A can display information on a displaying device 22, for example, the information that the vehicle C, which exists in front of the vehicle A, is passing through an intersection. Thus, an environment in the traveling direction can be confirmed before the vehicle passes there.

According to the vehicle communication device of the present invention, a vehicle communication device of a vehicle, which is located where no obstacles around it, can be selected as an object to relay the information by a simple means such as the traveling lane detecting means. Thus, a low-cost device, which can send and receive the information appropriately and effectively, can be provided Even when the information cannot be sent and received directly between the vehicles because of obstacles such as buildings, which block the sending and receiving signals, according to the vehicle communication device of the present invention, the information can be sent and received more effectively than the case where the information is randomly relayed among the vehicles. Further, according to the present invention, the vehicle communication device includes the wireless transceiver in which the first sending process means, the second sending process means, the first receiving process means and the second receiving process means are mounted to each of the plural vehicles. With such a simple configuration, the signals can be sent and received appropriately. Furthermore, the traveling lane detecting means of the vehicle communication device detects one of whether the road is crossed, forked or merged. Thus, the device can determines whether or not the relay is appropriate, and the signals can be sent and received appropriately.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A vehicle communication device mounted to a vehicle for sending and receiving information among plural vehicles which each have the vehicle communication device, comprising:

a traveling lane detecting means for detecting a detection result based on one of whether a road is crossed, forked, or merged; and an appropriateness of relay determining means for determining an appropriateness of relay on the basis of the detection result detected by the traveling lane detecting means, wherein, when one of whether the road is either crossed, forked or merged is detected by the traveling lane detecting means of one vehicle and the appropriateness of relay determining means determines that one vehicle is appropriate to relay the signal, the vehicle communication device of another vehicle assigns the one vehicle to relay the information as an assigned vehicle, and the vehicle communication device sends the information to the assigned vehicle.

2. A vehicle communication device mounted to a vehicle for sending and receiving information among plural vehicles which each have the vehicle communication device, comprising:

a traveling lane detecting means for detecting a detection result based on one of whether a road is crossed, forked, or merged;

an appropriateness relay determining means for determining an appropriateness of relay on the basis of the detection result detected by the traveling lane detecting means;

a first sending process means for sending a first signal including information indicating a vehicle condition and the detection result determined by the appropriateness of relay determining means;

a first receiving process means for receiving the first signal sent by the first sending process means and memorizing the first signal in a memorizing means;

a second sending process means for determining the appropriateness for relaying on the basis of the first signal memorized in the memorizing means, and sending a second signal including information of a vehicle assigned to relay the signal when the traveling lane detecting means detects the road is either crossed, forked, or merged; and a second receiving process means for receiving the second signal sent by the second sending process means, the second receiving process means determining whether or not the relay request exists, and relaying the signal to the assigned vehicle, wherein one of the plural vehicles sends the first signal to each of the other plural vehicles by way of the first sending process means, each of the other plural vehicles receives the first signal by way of the first receiving process means and memorizes the first signal in their respective memorizing means, the second sending process means of each of the other plural vehicles determines the appropriateness for relaying on the basis of the first signal memorized in their respective memorizing means, the second sending process means of each of the other plural vehicles sends the second signal to the second receiving process means of the one of the plural vehicles, and the second receiving process means of the one of the plural vehicles determines whether or not the relay request exists and relays the signal.

3. The vehicle communication device according to claim 2 further including a wireless transceiver, in which the first sending process means, the second sending process means, the first receiving process means and the second receiving process means are mounted.

4. The vehicle communication device according to claim 2, wherein the vehicle condition includes a location, a traveling direction and a traveling condition of a user's vehicle.

5. The vehicle communication device according to claim 2, wherein the traveling lane detecting means includes an optical sensor, a magnetometric sensor and a camera, the optical sensor and the magnetometric sensor being provided at the front portion of the vehicle and the camera being attached at the rear portion of the vehicle and used for assisting a parking operation.

6. The vehicle communication device according to claim 2, wherein the appropriateness of relay determining means determines an appropriateness of relay at the processing device, which is connected to a navigation device and a displaying device.

7. The vehicle communication device according to claim 4, wherein an vehicle ID and a data serial number is assigned to data of the location and the traveling direction of the user's vehicle and the data is sent as the first signal by the first sending process means to vehicles around the user's vehicle.

8. The vehicle communication device according to claim 2, wherein a vehicle located at the front of the user's vehicle is assigned to be requested to relay the signal.

9. The vehicle communication device according to claim 2, wherein the traveling lane detecting means includes at least one of an optical sensor, a magnetometric sensor and a camera.

10. The vehicle communication device according to claim 9, wherein the traveling lane detecting means comprises an optical sensor provided at the front portion of the vehicle.

11. The vehicle communication device according to claim 9, wherein the traveling lane detecting means comprises a magnetometric sensor provided at the front portion of the vehicle.

12. The vehicle communication device according to claim 9, wherein the traveling lane detecting means comprises a camera provided at the rear portion of the vehicle and used for assisting a parking operation.

13. The vehicle communication device according to claim 2, wherein the vehicle communication device assigns a vehicle positioned/traveling on any of the crossed road, the forked road or the merged road as the relay requested vehicle for relaying the information.

* * * * *